US007516565B1

(12) United States Patent
Tsen

(10) Patent No.: US 7,516,565 B1
(45) Date of Patent: Apr. 14, 2009

(54) STEAM CHANNELING STRUCTURE

(76) Inventor: Samson Tsen, No. 8, Lane 249, Lung-Chiang Rd., Chung-Shan Dist., Taipei City (TW)

( * ) Notice: Subject to any disclaimer, the term of this patent is extended or adjusted under 35 U.S.C. 154(b) by 0 days.

(21) Appl. No.: 12/052,033

(22) Filed: Mar. 20, 2008

(51) Int. Cl.
*D06F 75/20* (2006.01)
*D06F 75/06* (2006.01)

(52) U.S. Cl. ..... 38/77.1; 15/321

(58) Field of Classification Search ..... 38/74–97; 15/320, 410, 321, 328; 68/222
See application file for complete search history.

(56) References Cited

U.S. PATENT DOCUMENTS 2,674,819 A * 4/1954 Zastrow et al. ..... 38/77.3
2,713,225 A * 7/1955 Wolcott ..... 38/99
3,675,449 A * 7/1972 Bluestein ..... 68/222
3,721,026 A * 3/1973 McCallum ..... 38/75
3,983,644 A * 10/1976 Gowdy ..... 38/77.83
4,692,588 A * 9/1987 Cavalli ..... 219/245
5,400,462 A * 3/1995 Amoretti ..... 15/321
5,609,047 A * 3/1997 Hellman et al. ..... 68/222
5,642,579 A 7/1997 Netten et al.
6,061,935 A * 5/2000 Lee ..... 38/77.6
6,079,133 A 6/2000 Netten
6,438,876 B2 8/2002 Har et al.
6,484,347 B1 11/2002 Wang
6,490,753 B1 12/2002 Chen
6,513,269 B2 * 2/2003 Kobayashi et al. ..... 38/93
6,536,379 B1 3/2003 Liu
6,711,840 B1 3/2004 Rosenzweig
6,877,183 B2 4/2005 Rosa et al.
6,935,056 B2 8/2005 Milanese
6,986,217 B2 * 1/2006 Leung et al. ..... 38/77.83
7,051,462 B1 5/2006 Rosenzweig
7,389,597 B1 * 6/2008 Chen ..... 38/77.83
2007/0102414 A1 5/2007 Jiang et al.

* cited by examiner

*Primary Examiner*—Ismael Izaguirre
(74) *Attorney, Agent, or Firm*—Frenkel & Associates, P.C.

(57) ABSTRACT

A steam channeling structure adopted for use on a steam iron to transfer steam to perform cleaning function. The steam iron includes at least a soleplate heated to perform ironing function and at least one steam vent. The steam channeling structure includes a coupling dock and at least one cleaning tool mounted onto the coupling dock. The coupling dock has a protective portion to cover the soleplate and a steam directing portion communicating with the steam vent to direct steam discharged through the steam vent. The cleaning tool has a steam passage connecting to the steam directing portion and a steam channeling vent located in the steam passage. Steam generated by the steam iron is conveyed through the steam directing portion to the steam channeling vent to be discharged to perform steam cleaning function on a selected article.

16 Claims, 10 Drawing Sheets

STEAM CHANNELING STRUCTURE

FIELD OF THE INVENTION

The present invention relates to a steam channeling structure and particularly to a steam channeling structure to transform a steam iron to provide steam cleaning function.

BACKGROUND OF THE INVENTION

Steam iron aims to remove wrinkles of clothes or fabrics through heat. It is widely used in houses and businesses. The steam iron ejects steam during ironing the clothes. Compared with the traditional iron there is no need to spray moisture. Moreover, the ejected steam can protect the clothes from being damaged by the high temperature of the iron. In addition, the steam can quickly penetrate inside the fibers of the clothes and heat evenly so that the fibers can be rearranged to form a desired shape. References of steam iron can be found in U.S. Pat. Nos. 6,935,056, 6,438,876, 6,079,133, 5,642,579 and publication No. 20070102414. They mostly have an iron body with a steam chamber inside to generate steam which is delivered to at least one steam output vent and discharged to clothes to be ironed.

The steam, aside from ironing clothes or fabrics through the steam iron, can also serve dirt removing function, such as a steam cleaner. The conventional steam cleaner can be divided into portable steam cleaner and detachable steam cleaner. The portable steam cleaner is compact and easier to use. References can be found in U.S. Pat. Nos. 6,536,379, 6,490,753 and 6,484,347. They generally have a water reservoir located in a body and a pump to deliver water in the water reservoir to a heating means. The water is heated to become steam to be ejected through a nozzle. The detachable steam cleaner, such as one disclosed in U.S. Pat. No. 6,877,183, has a bigger size than the portable one, and mainly has a water reservoir and a heating means located respectively in a chassis and a cleaning tool that are connected through a flexible hose. Water held in the water reservoir is sent to the heating means through the hose to be heated into steam. The steam is discharged through a steam vent formed on the cleaning tool. Oil stains and dirt smears on the surface of targeted articles can be easily removed by the high temperature steam generated by the steam cleaner without adding chemical agents. As it does not create environmental pollution and is harmless to human body, it is well accepted on the market.

While the devices mentioned above all perform functions through steam, different devices have to be used for different applications. It is not desirable in terms of convenience or economy. Some techniques have been proposed to address this issue, such as U.S. Pat. Nos. 7,051,462 and 6,711,840. They propose a combined steam cleaner and steam iron. They have a steam generation unit located on a chassis to be selectively coupled with a steam cleaning unit or a steam iron unit. The steam cleaning unit or the steam iron unit performs cleaning or ironing through steam generated by the steam generation unit. The steam is transported through a duct. The steam is easily condensed to become water or a lower quality steam of a higher water content in the duct. As a result, the clothes being treated are easily damped. Moreover, the steam cleaning unit or the steam iron unit is a separated element. Total size is bulky and not easy to carry or move. It is also difficult to be stored in a small room. This creates a cluttered environment or makes tidying of the environment difficult.

SUMMARY OF THE INVENTION

The primary object of the present invention is to provide a steam channeling structure that allows a steam iron to perform clothes ironing or cleaning function according to different requirements. To achieve the foregoing object, the steam channeling structure of the invention is adopted for use on a steam iron to transfer steam for cleaning purpose. The steam iron includes at least a soleplate heated to do ironing and at least one steam vent. The steam channeling structure also has a coupling dock and at least one cleaning tool located on the coupling dock. The coupling dock has a protective portion covering the soleplate and a steam directing portion communicating with the steam vent to direct steam discharged from the steam vent. The cleaning tool has a steam passage communicating with the steam directing portion and a steam channeling vent located in the steam passage. Steam generated by the steam iron is conveyed through the steam directing portion to the steam channeling vent to be discharged to do cleaning on selected articles. The coupling dock and the cleaning tool are integrally formed. They also may have respectively a first coupling portion and a second coupling portion that correspond to each other to form coupling, and also may be detached as desired. The steam directing portion further has a connection end connecting to the steam vent and a pressure boosting chamber located between the connection end and the steam passage so that powerful steam can be ejected through the steam channeling vent.

Another object of the invention is to provide storing and moving facility for the steam iron equipped with the steam channeling structure set forth above. To achieve the foregoing object, the invention further includes a first seat with a water reservoir located thereon communicating with the iron body and a first housing space to hold the steam iron. The first seat has a shoulder strap to facilitate carrying by users. There is also a second seat with a second housing space formed thereon to hold the first seat. The second seat has a storage room to hold the coupling dock and the cleaning tool and at least one moving wheel.

The steam channeling structure thus formed allows one steam iron to perform steam ironing and steam cleaning functions at the same time. When in use to do steam cleaning, different cleaning tools may be selected according to cleaning requirements to be coupled with the coupling dock. Thus utilization of the steam iron can be expanded. There is no need for users to purchase separate steam iron and steam cleaner to do clothes ironing or article cleaning. Thus it is more economic effect. There is also no complicated assembly process when in use. The integrated storage room provided by the invention also makes carrying and storing easier.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
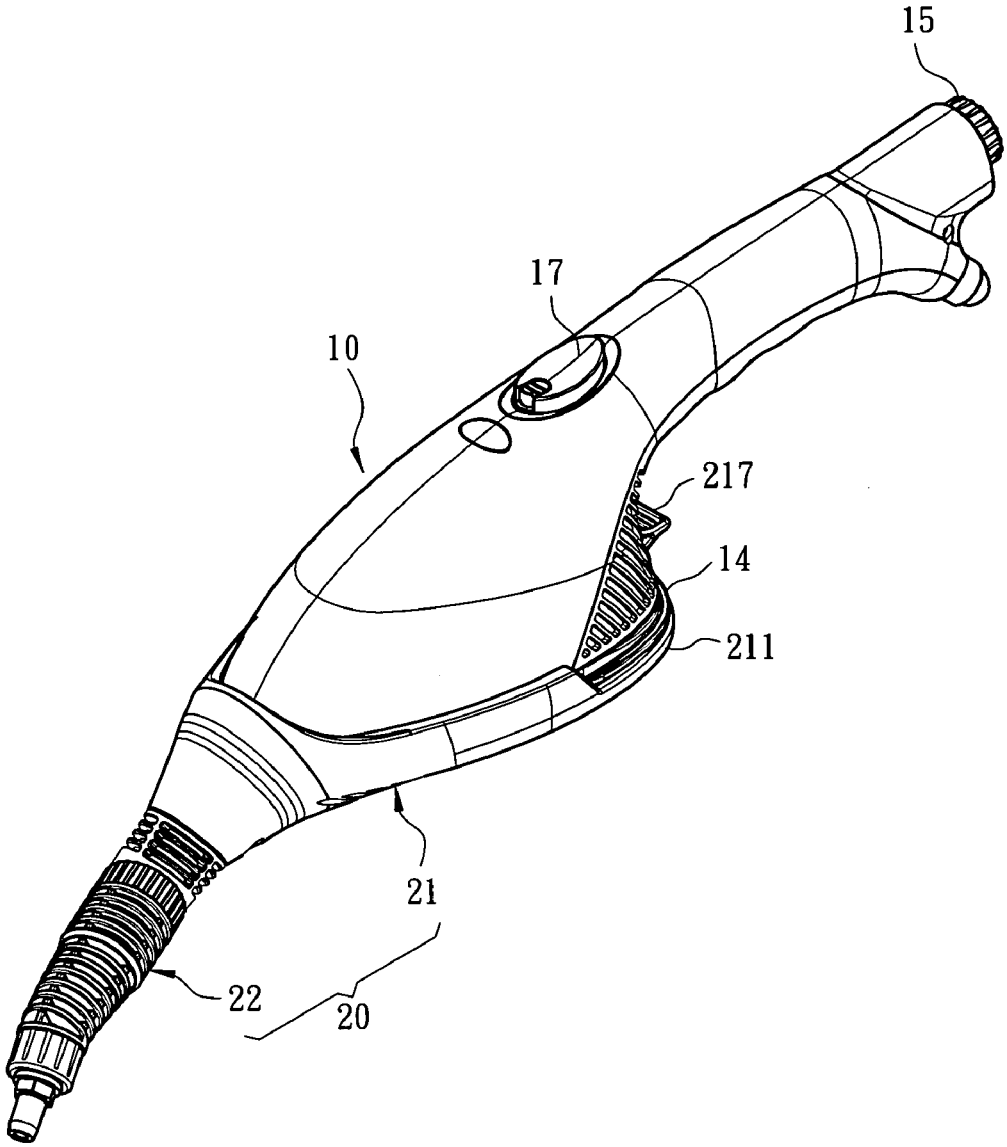
FIG. 1 is a perspective view of an embodiment of the invention incorporating with a steam iron.
Figure 2:
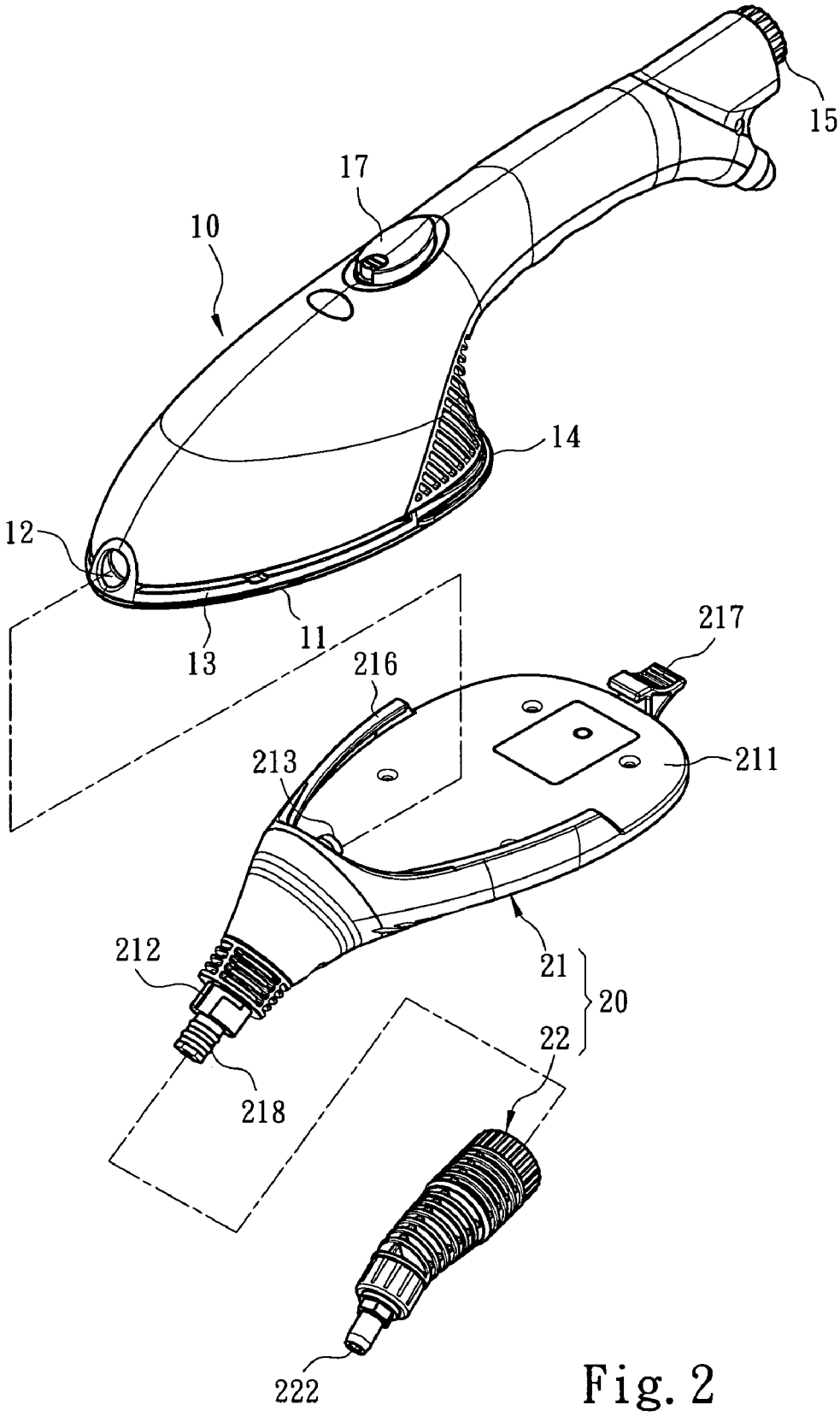
FIG. 2 is an exploded view of an embodiment of the invention incorporating with a steam iron.
Figure 3:
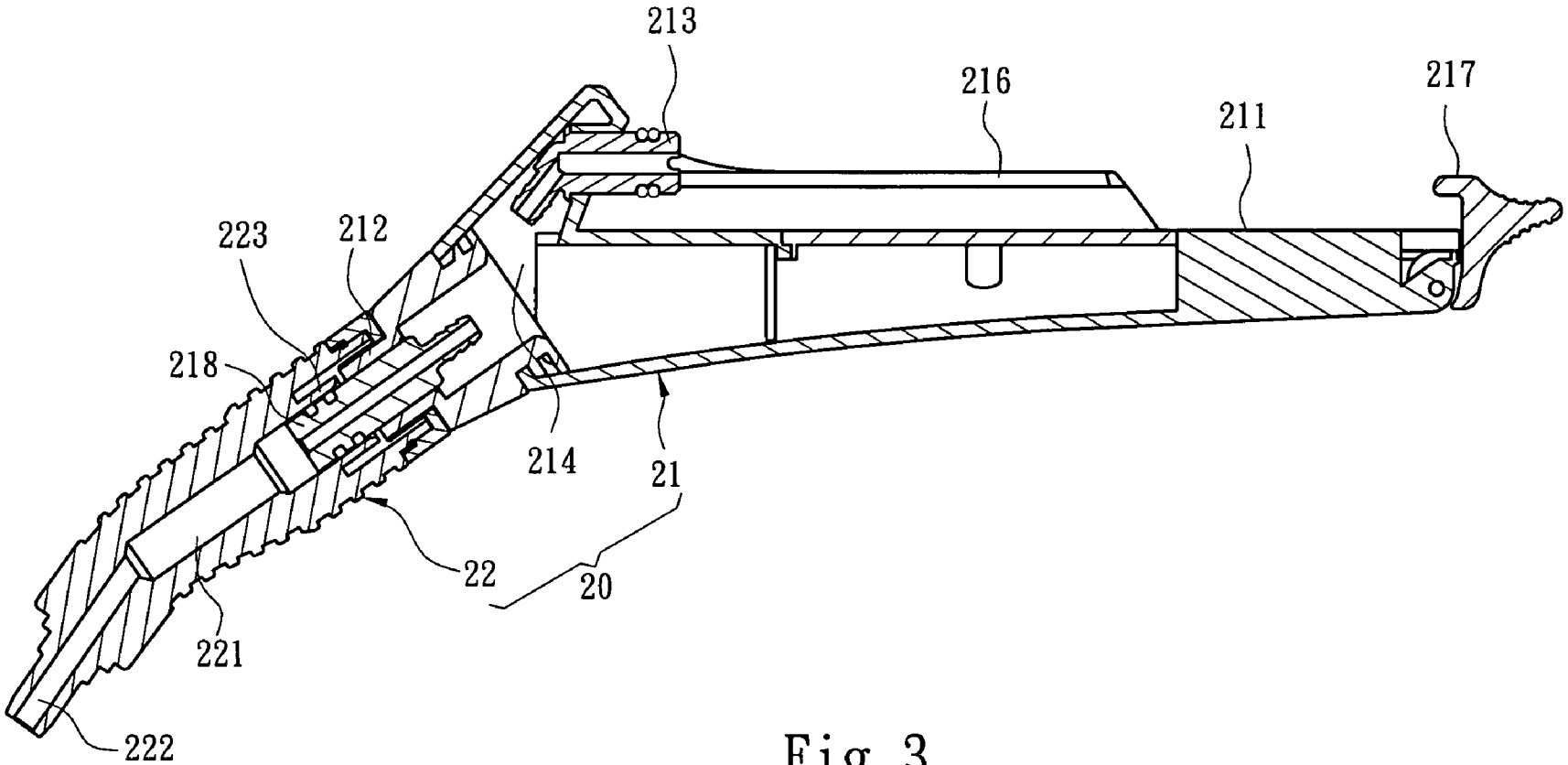
FIG. 3 is a sectional view of an embodiment of the invention incorporating with a steam iron.

Please refer to FIGS. 1, 2 and 3 for an embodiment of the invention incorporating with a steam iron. The steam channeling structure 20 of the invention is adopted for use on a steam iron 10 to transform the steam iron to provide steam cleaning function. The steam iron 10 includes a soleplate 11 to be heated to perform ironing function and at least one steam vent 12. The steam channeling structure 20 includes a coupling dock 21 and a cleaning tool 22 fastened to the coupling dock 21. The coupling dock 21 is mounted onto the steam iron 10, and has a protective portion 211 covering the soleplate 11 and a steam directing portion 212 communicating with the steam vent 12 to direct steam discharged from the steam vent 12. The protective portion 211 aims to isolate the soleplate 11 from in contact with users to avoid scalding the users resulting from incidental touching. To enhance heat isolation effect of the protective portion 211, it has a heat isolation layer located thereon. The cleaning tool 22 includes a steam passage 221 communicating with the steam directing portion 212 and a steam channeling vent 222 located in the steam passage 221. Steam generated by the steam iron 10 is conveyed through the steam directing portion 212 to the steam channeling vent 222 to be discharged to clean a selected article. The steam directing portion 212 further has a connection end 213 connecting to the steam vent 12 and a pressure boosting chamber 214 located between the connection end 213 and the steam passage 221. The steam discharged from the steam vent 12 passes through the pressure boosting chamber 214 and is maintained at a high pressure to be delivered to the steam channeling vent 222.

In order to form a secure connection between the steam channeling structure 20 and the steam iron 10 without separating when in use and causing scalding risk to users, the steam iron 10 has two fastening flutes 13, and the coupling dock 21 has two fastening flanges 216 corresponding to and engageable with the two fastening flutes 13 to allow the steam iron 10 to form a secure coupling with the coupling dock 21. Moreover, the steam iron 10 and the coupling dock 21 further have respectively a latch element 14 and a coupling element 217 engageable with each other to allow the coupling dock 21 to be firmly latched on the steam iron 10 without loosening off.

The steam iron 10 in the embodiment has at least one steam vent 12. For instance, the steam iron 10 shown in FIGS. 1 and 2 has two or more steam vents 12 located respectively on the soleplate 11 to be used for ironing clothes and at a front end thereof to discharge high pressure steam jet. In order to facilitate switching of the two steam vents 12, a switch unit 17 is provided on the steam iron 10 to deliver different steam output through the different steam vents 12.

Figure 4A:
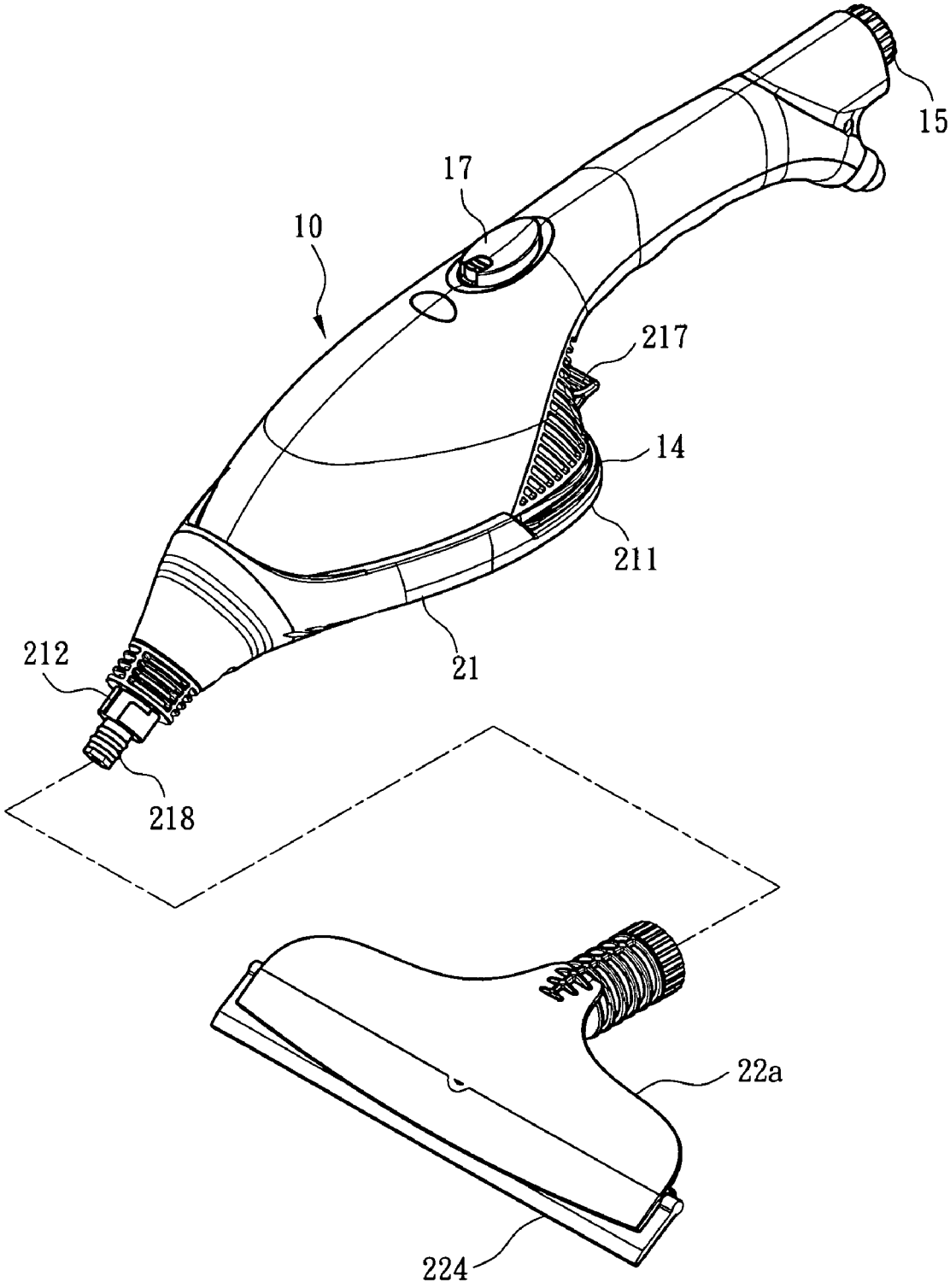
FIGS. 4A and 4B are a perspective view and a fragmentary sectional view of an embodiment of the invention incorporating with a scraping knife as a cleaning tool.
Figure 4B:
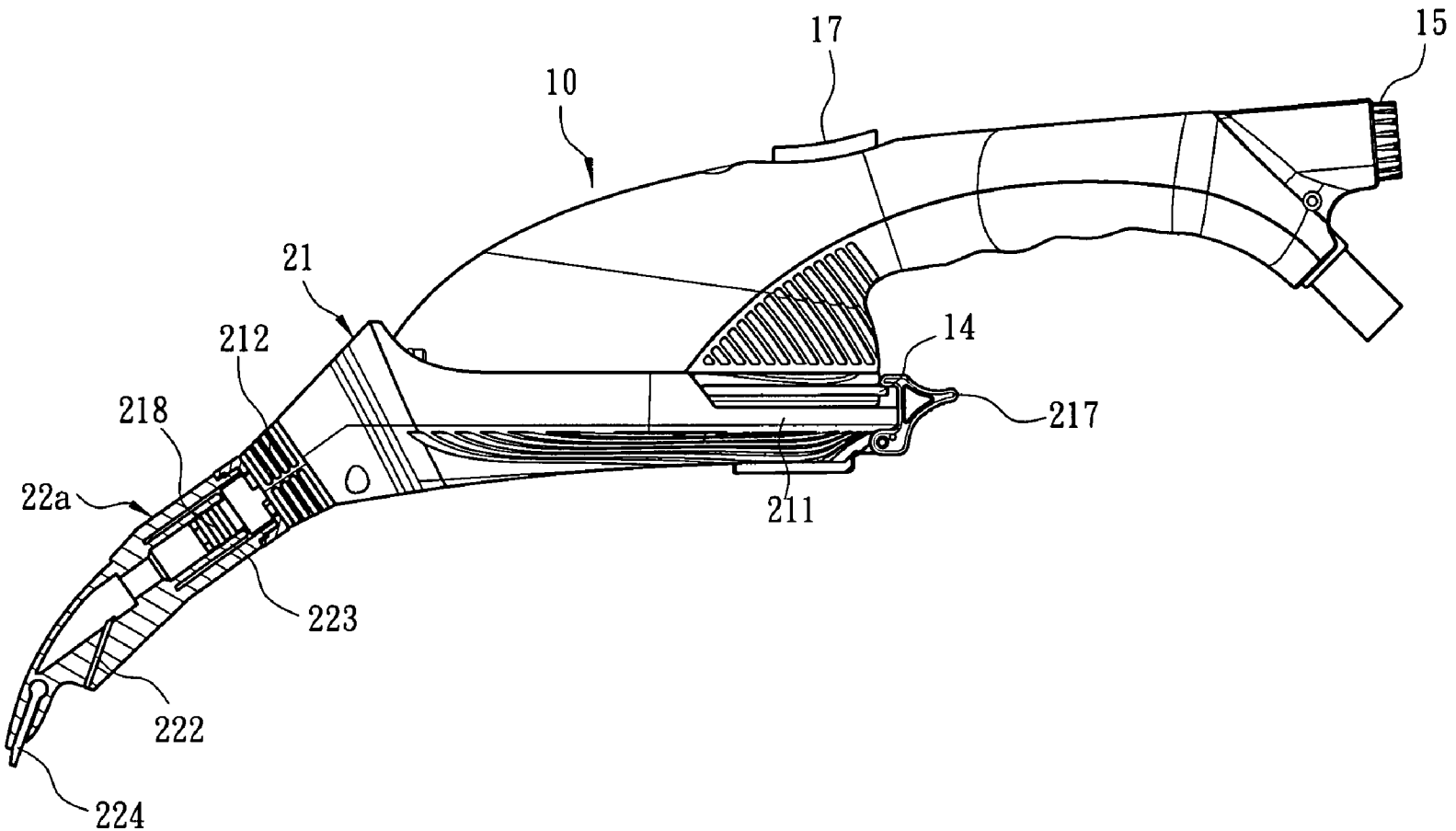
Figure 5A:
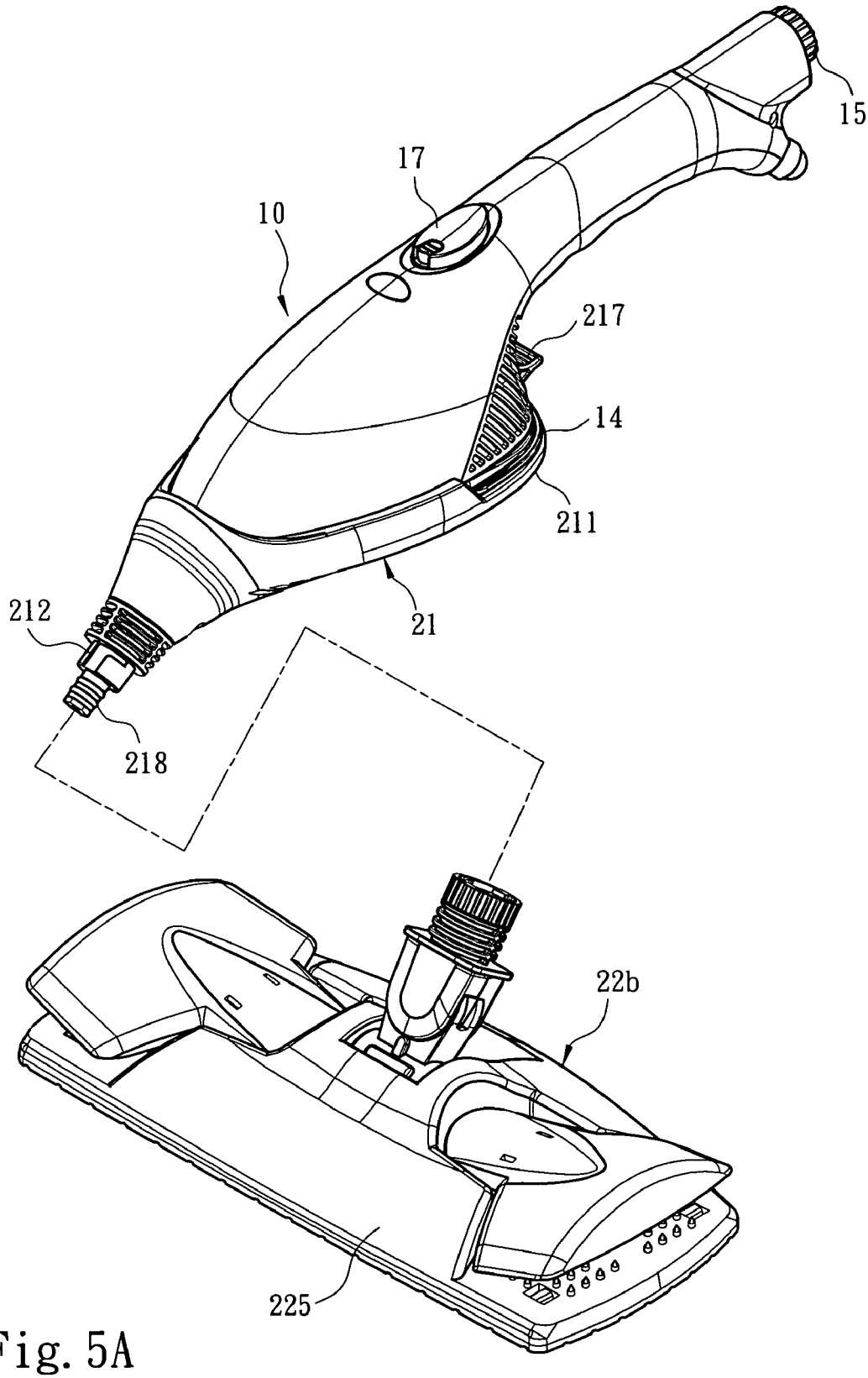
FIGS. 5A, 5B and 5C are a perspective view, a bottom view and a fragmentary view of an embodiment of the invention incorporating with a rectangular cleaning tool.
Figure 5B:
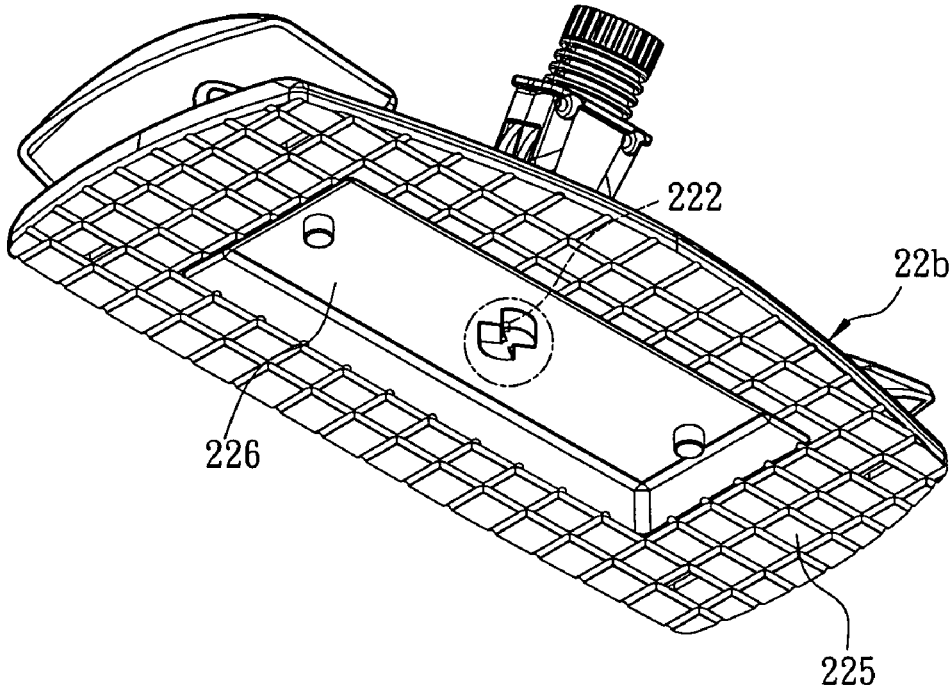
Figure 5C:
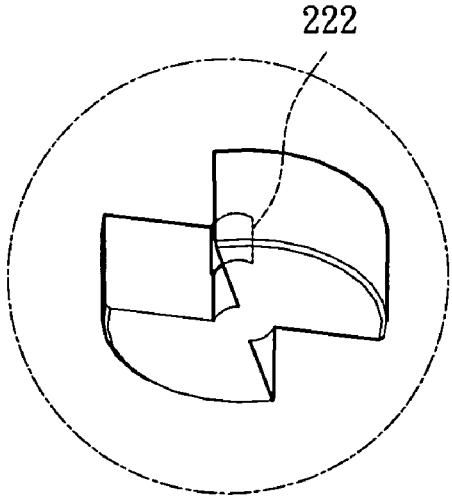
Figure 6:
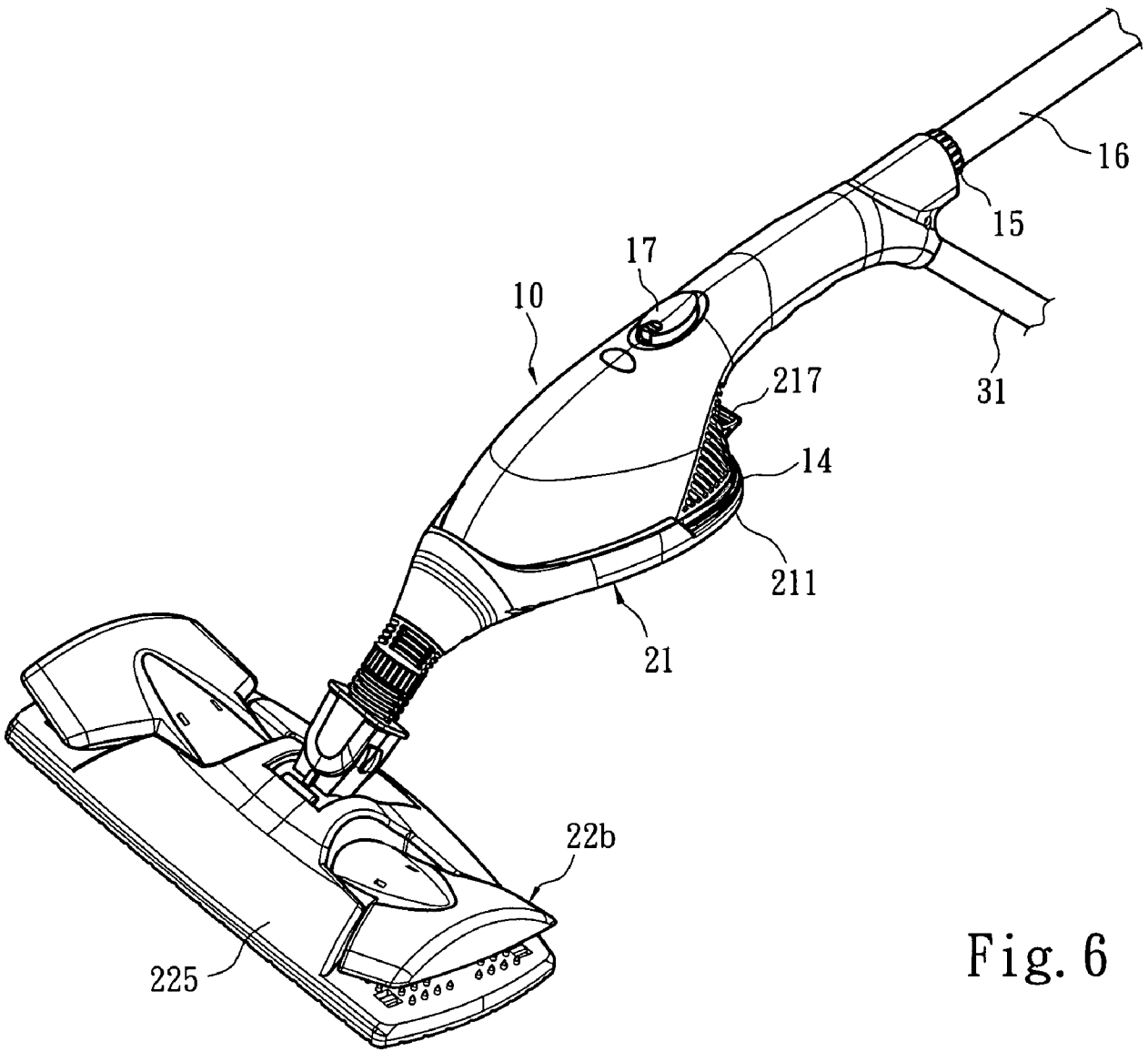
FIG. 6 is a perspective view of an embodiment of the steam iron of the invention incorporating with a first extension rod.

In the steam channeling structure 20, the coupling dock 21 and the cleaning tool 22 may be formed in an integrated manner to switch steam output mode of the steam iron 10. The coupling dock 21 and the cleaning tool 22 may also be separated so that different types of cleaning tools 22 can be selected to couple with the coupling dock 21 to allow the steam iron 10 to output steam in varying modes. In the embodiment shown in FIGS. 2 and 3 the coupling dock 21 and the cleaning tool 22 are separable. The coupling dock 21 and the cleaning tool 22 have respectively a first coupling portion 218 and a second coupling portion 223 that are engageable with each other. The cleaning tool 22 may have many different selections. For instance, the one shown in FIGS. 2 and 3 is an ejection gun. The steam discharged from the steam vent 12 passes through the steam directing portion 212 and enters the cleaning tool 22. The steam passage 221 is a narrow passage so that a powerful steam jet is ejected through the steam channeling vent 222 in a converged fashion to remove dirt on a target article. FIGS. 4A and 4B illustrate another embodiment in which the cleaning tool 22*a* is a scraping knife. While the steam ejected through the steam channeling vent 222 is performing cleaning function, the scraping knife 224 at the front end can be used to remove dirt located in the range of the scraping knife 224. FIGS. 5A, 5B and 5C show yet another embodiment in which the cleaning tool 22*b* is a rectangular board. Aside from the second coupling portion 223, the steam passage 221 and the steam channeling vent 222, a wiper body 225 is provided with steam troughs 226 formed at the bottom thereof communicating with the steam channeling vent 222. The steam troughs 226 can increase steam contact area to clean a larger environment such as floors, walls or the like. The cleaning tools 22, 22*a* and 22*b* previously discussed are merely examples of the embodiments, and not the limitation of the invention. Any other cleaning tools capable of connecting to the coupling dock 21 can be used and are within the claim scope of the invention. FIG. 6 illustrates another embodiment in which the steam iron 10 has a coupling trough 15 insertable by a first extension rod 16. Taken the rectangular cleaning tool 22*b* as an example, the steam iron 10 fastened to the first extension rod 16 and coupled with the cleaning tool 22*b* can function as a wiper.

Figure 7:
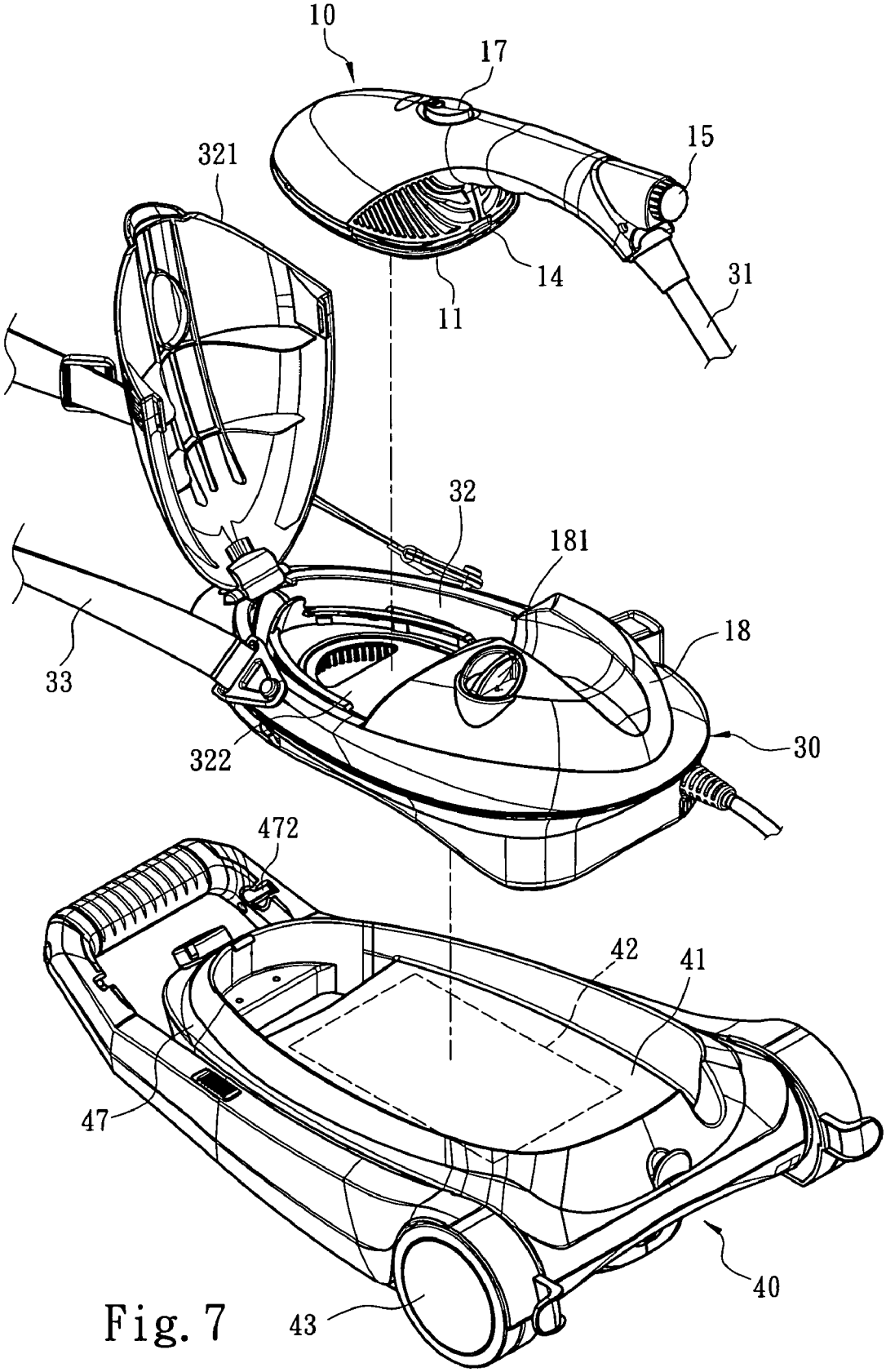
FIG. 7 is an exploded view of an embodiment of the invention including a water reservoir located outside of the steam iron to be incorporated with a first seat and a second seat.

The steam iron 10 may contain a water reservoir 18. The water reservoir 18 may also be located outside the steam iron 10 and connected to the steam iron 10. The structure of locating the water reservoir 18 outside the steam iron 10 makes carrying and storing easier. Referring to FIG. 7, the water reservoir 18 is located on a first seat 30 and has a water inlet 181 to receive water from an external source. The water reservoir 18 is connected to the steam iron 10 through a connection duct 31. The first seat 30 further has a first housing space 32 to hold the steam iron 10. The first housing space 32 has a flippable cap 321 and a base 322. The base 322 may include a heat isolation layer to prevent the structure of the first seat 30 from being damaged by the heat transferred from the soleplate 11 of the steam iron 10. When the steam iron 10 is not in use, the flippable cap 321 may be lifted to dispose the steam iron 10 in the base 322, then the flippable cap 321 is closed to hold the steam iron 10 in the first housing space 32. In addition, by separating the water reservoir 18 from the steam iron 10, a shoulder strap 33 may be provided on the first seat 30 to make carrying the steam iron 10 easier.

Also referring to FIG. 7, in order to facilitate holding of the elements previously discussed and moving, a second seat 40 may be provided with a second housing space 41 formed thereon to hold the first seat 30. The second seat 40 also has a storage room 42 to hold the coupling dock 21 and the cleaning tool 22, and at least one moving wheel 43. Thus the first seat 30 and the cleaning tool 22 can be neatly held in the second seat 40 to prevent cluttering. The moving wheel 43 makes moving and transporting of the invention more convenient.

Figure 8:
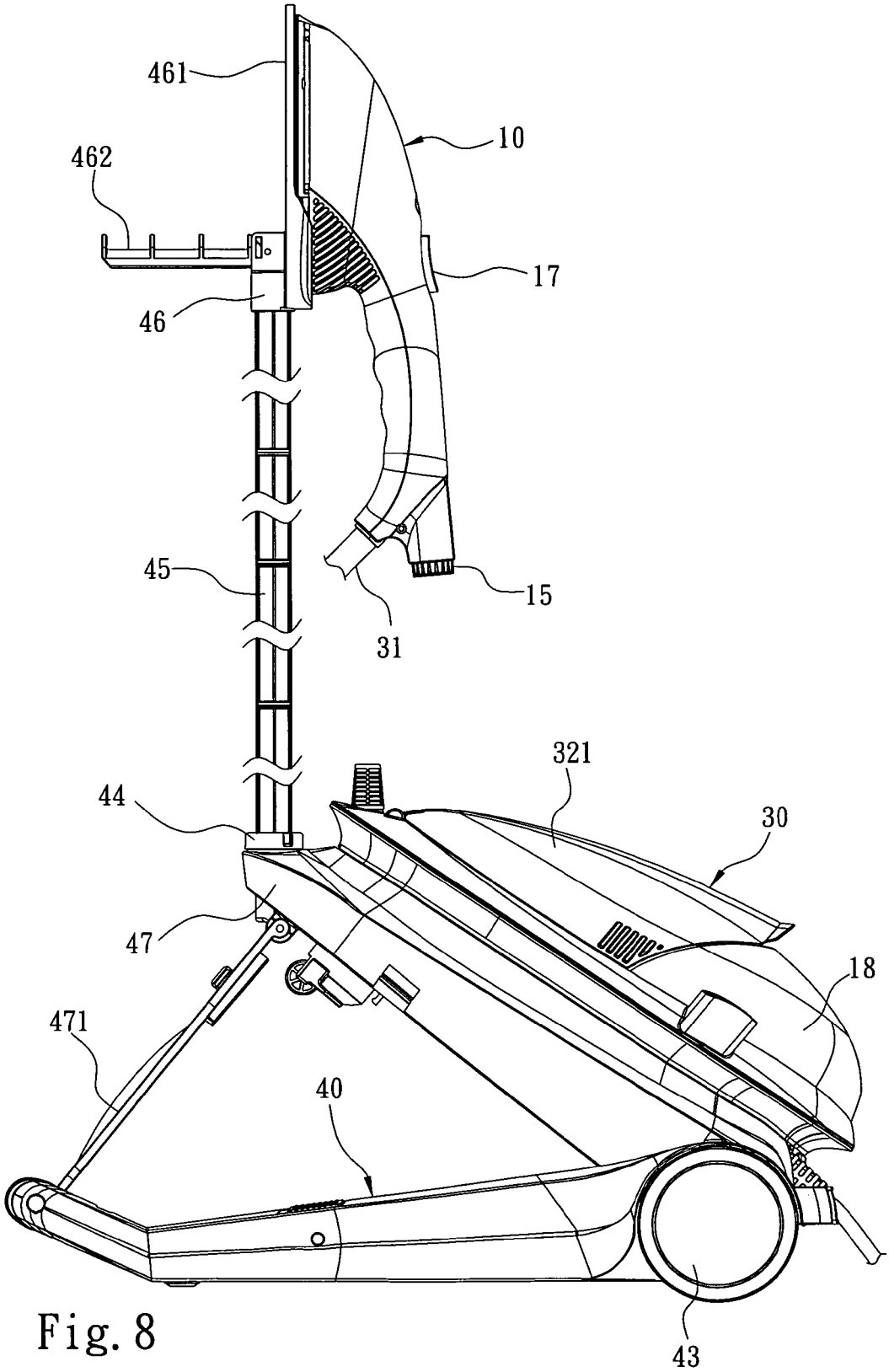
FIG. 8 is a perspective view of an upright steam cleaner according to the invention in a use condition.

Refer to FIG. 8 for yet another embodiment of the invention in which the steam iron 10 functions as an upright steam cleaner. The second seat 40 has a bracing element 44 and a second extension rod 45 coupling on the bracing element 44. The second extension rod 45 has other end coupling with a holding portion 46. The holding portion 46 has a holding rack 461 to hold the steam iron 10 and a clothes rack 462 hinged on the holding portion 46. The second extension rod 45 may function like the first extension rod 16 previously discussed to maneuver the steam iron 10. It is mounted onto the bracing element 44 to be incorporated with the holding portion 46 to become an upright clothes rack 462 to hang clothes to facilitate steam cleaning. Also referring to FIGS. 7 and 8, the bracing element 44 may further have a raising portion 47 which includes a movable rack 471 and an anchor trough 472 to anchor the movable rack 471. In this embodiment one end of the raising portion 47 can be hinged on the second seat 40 and is swivelable. When the raising portion 47 is lifted and swiveled to a desired location, the movable rack 471 can be moved to wedge in the anchor trough 472 to anchor the raising portion 47. Thus by adjusting the position of the raising portion 47, the length of the second extension rod 45 can be made shorter.

As a conclusion, the steam channeling structure 20 of the invention allows one steam iron 10 to perform clothes ironing or steam cleaning function as required. The entire structure is simple, and coupling of the steam channeling structure 20 and the steam iron 10 is easy. Storing is tidy without clutter. The steam iron 10, the coupling dock 21 and the cleaning tool 22 can be held in the first seat 30 and the second seat 40 without scattering and cluttering the environment. Through the shoulder strap 33 on the first seat 30 and the moving wheel 43 on the second seat 40, carrying and moving of the invention is easier. It provides a significant improvement over the conventional techniques.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A steam channeling structure to transform a steam iron to perform steam cleaning function that has at least a soleplate heated to do ironing and wherein the steam iron has at least two steam vents and a switch unit to determine which of the steam vents to discharge the steam generated by the steam iron, the steam channeling structure comprising:

a coupling dock which is located on the steam iron and includes a protective portion covering the soleplate and a steam directing portion communicating with said steam vents; and at least one cleaning tool which is located on the coupling dock and includes a steam passage communicating with the steam directing portion and a steam channeling vent located in the steam passage to discharge steam generated by the steam iron and passed through the steam directing portion to preform steam cleaning on a selected article.

2. The steam channeling structure of claim 1, wherein the coupling dock and the cleaning tool are integrally formed.

3. The steam channeling structure of claim 1, wherein the coupling dock and the cleaning tool have respectively a first coupling portion and a second coupling portion that correspond to and engageable with each other.

4. The steam channeling structure of claim 1, wherein the protective portion has a heat isolation layer.

5. The steam channeling structure of claim 1, wherein the steam directing portion includes a connection end connecting to the steam vent and a pressure boosting chamber located between the connection end and the steam passage.

6. The steam channeling structure of claim 1, wherein the steam iron has two fastening flutes and the coupling dock has two fastening flanges corresponding to the fastening flutes to fasten the steam iron to the coupling dock.

7. The steam channeling structure of claim 6, wherein the steam iron and the coupling dock have respectively a latch element and a coupling element corresponding to each other.

8. The steam channeling structure of claim 1, wherein the steam iron has a coupling trough to be wedged in by a first extension rod.

9. The steam channeling structure of claim 1, wherein the steam iron has a water reservoir.

10. The steam channeling structure of claim 9, wherein the water reservoir is located on a first seat and communicates with the steam iron through a connection duct, the first seat having a first housing space to hold the steam iron.

11. The steam channeling structure of claim 10, wherein the first seat has a flappable cap and a base to form the first housing space.

12. The steam channeling structure of claim 10, wherein the first seat has a shoulder strap to carry thereof by a user.

13. The steam channeling structure of claim 10, wherein the first seat is located on a second seat, the second seat having a second housing space to hold the first seat and at least one moving wheel.

14. The steam channeling structure of claim 13, wherein the second seat has a storage room to hold the coupling dock and the cleaning tool.

15. The steam channeling structure of claim 13, wherein the second seat has a bracing element and a second extension rod located on the bracing element, the second extension rod having a holding portion at other end that has a holding rack to hold the steam iron and a clothes rack hinged on the holding portion.

16. The steam channeling structure of claim 15, wherein the second seat has a raising portion which includes a movable rack and an anchor trough to anchor the movable rack.

* * * * *